US010054306B2

(12) United States Patent
Liu

(10) Patent No.: US 10,054,306 B2
(45) Date of Patent: Aug. 21, 2018

(54) PUSH-OUT TYPE MINIATURE ELECTRIC SHOCK FLASHLIGHT CAPABLE OF AUTOMATICALLY RESETTING

(71) Applicant: JIANGSU TIANWANG SOLAR TECHNOLOGY CO., LTD, Taizhou, Jiangsu (CN)

(72) Inventor: Jingjuan Liu, Jiangsu (CN)

(73) Assignee: JIANGSU TIANWANG SOLAR TECHNOLOGY CO., LTD, Taizhou, Jiangsu (CN)

( * ) Notice: Subject to any disclaimer, the term of this patent is extended or adjusted under 35 U.S.C. 154(b) by 0 days.

(21) Appl. No.: 15/542,065

(22) PCT Filed: Dec. 3, 2015

(86) PCT No.: PCT/CN2015/096274
§ 371 (c)(1),
(2) Date: Jul. 6, 2017

(87) PCT Pub. No.: WO2017/084116
PCT Pub. Date: May 26, 2017

(65) Prior Publication Data

US 2017/0363280 A1 Dec. 21, 2017

(30) Foreign Application Priority Data

Nov. 18, 2015 (CN) ..... 2015 1 0795694

(51) Int. Cl.
*F21V 33/00* (2006.01)
*F21V 23/04* (2006.01)
(Continued)

(52) U.S. Cl.
CPC ..... *F21V 33/0076* (2013.01); *F21L 4/005* (2013.01); *F21V 15/01* (2013.01);
(Continued)

(58) Field of Classification Search
CPC ... F21V 33/00; F21L 4/00; F21L 13/00; F21L 4/04
(Continued)

(56) References Cited

U.S. PATENT DOCUMENTS 4,968,034 A 11/1990 Hsieh
9,759,414 B2 * 9/2017 West ..... F21V 23/0428
(Continued)

FOREIGN PATENT DOCUMENTS

CN 101813240 A 8/2010
CN 201757623 U 3/2011
(Continued)

*Primary Examiner* — Edwyn Labaze
(74) *Attorney, Agent, or Firm* — Novick, Kim & Lee, PLLC; Allen Xue

(57) ABSTRACT

The present invention relates to a push-out type miniature electric shock flashlight capable of automatically resetting, comprising a flashlight body shell, a plastic main body part, an integrated circuit board assembly and a base plate, an open slot; the plastic main body part comprises an operating member and a power control member, an LED lamp and electric shock sheets are provided inside the operating member, an ignition coil and a polymer lithium battery are provided inside the power control member, and a guide slot is also provided on a bottom surface of the power control member; the circuit board assembly is arranged between the polymer lithium battery and the plastic main body part and comprises a lighting switch, an electric shock/lighting change-over switch, a charging indicator, a USB interface and an electric shock switch; a joint pin and a guide block.

10 Claims, 3 Drawing Sheets

(51) Int. Cl.

| | |
|---|---|
| ***F21L 4/00*** | (2006.01) |
| ***F21V 15/01*** | (2006.01) |
| ***F41H 13/00*** | (2006.01) |
| *F21Y 115/10* | (2016.01) |

(52) U.S. Cl.
CPC ..... *F21V 23/0414* (2013.01); *F41H 13/0018* (2013.01); *F21Y 2115/10* (2016.08)

(58) Field of Classification Search
USPC ..... 362/253, 200, 202, 183, 208
See application file for complete search history.

(56) References Cited

U.S. PATENT DOCUMENTS

2009/0103231 A1 4/2009 Young
2010/0304874 A1* 12/2010 Abatemarco ..... A45B 3/04 463/47.3
2010/0309657 A1* 12/2010 Purdy ..... F21L 4/005 362/200
2013/0343042 A1* 12/2013 Windom ..... F21L 4/08 362/183
2014/0036485 A1* 2/2014 Parsons ..... F21L 4/005 362/183
2014/0140048 A1* 5/2014 Miller ..... H02J 7/0027 362/183
2014/0268713 A1* 9/2014 Unger ..... F21L 14/02 362/205
2016/0033091 A1* 2/2016 Sharrah ..... F21L 4/005 362/202
2016/0033093 A1* 2/2016 Workman ..... F21L 4/08 362/183
2016/0197502 A1* 7/2016 Waters ..... F21L 4/085 340/636.1

FOREIGN PATENT DOCUMENTS

CN 203453788 U 2/2014
CN 205118714 U 3/2016

* cited by examiner

PUSH-OUT TYPE MINIATURE ELECTRIC SHOCK FLASHLIGHT CAPABLE OF AUTOMATICALLY RESETTING

TECHNICAL FIELD OF THE INVENTION

The present invention relates to the technical field of lighting equipment, and in particular to a push-out type miniature electric shock flashlight capable of automatically resetting.

BACKGROUND OF THE INVENTION

Flashlight is a portable lighting tool. The existing flashlights commonly have a self-defense function in order to ensure the safety of a person working or walking at night. However, since a common self-defense flashlight is large in size and has a single control button, it is easy to hurt the person himself or others around when in use for the purpose of self-defensing, and also is restricted from being carrying along in many occasions.

The Utility Model China Patent No. 201420306388.3 claimed a multifunctional flashlight, comprising a flashlight body of the flashlight, a front cover and a spotlight. A rear end of the front cover is connected to the flashlight body by a front cover joint, a plurality of jagged teeth, inner sides of which are connected to a pair of electric shock electrodes by an insulating pad, are arranged on an outer periphery of a front end of the front cover, and circuits of the electric shock electrodes comprise ignition coils which are connected in series. Although this flashlight serves as a self-defense means in unlawful attack to some extent, it is not easy to carry along due to large size; moreover, its jagged teeth with a triangular pyramid-shaped structure easily cause accidental injury.

SUMMARY OF THE INVENTION

An objective of the present invention is to provide a push-out type miniature electric shock flashlight capable of automatically resetting, which is safe and reliable as well as practical and convenient.

A push-out type miniature electric shock flashlight capable of automatically resetting is provided, including a flashlight body shell, a plastic main body part, an integrated circuit board assembly and a base plate, an open slot being provided above the flashlight body shell.

The plastic main body part is a cuboid structure having an opening on one face and includes an operating member and a power control member, and an LED lamp, having an electric shock head and symmetrically arranged electric shock sheets provided on two sides thereof, is provided inside the operating member; an ignition coil and a polymer lithium battery, which are connected and covered by a detachable cover plate, are provided inside the power control member, the cover plate is connected and fixed to a pusher by a decorative sheet, and a guide slot is also provided on a bottom surface of the power control member.

The circuit board assembly is arranged between the polymer lithium battery and the plastic main body part and includes a lighting switch, an electric shock/lighting change-over switch, a charging indicator, a USB interface and an electric shock switch, and the lighting switch is located in the same vertical direction as the pusher; a joint pin and a guide block which coordinates with the guide slot are provided on the base plate, and the joint pin is coupled to the plastic main body part by an elastic element.

An input end of the ignition coil is connected to an output end of the polymer lithium battery whose input end is connected to the USB interface by the integrated circuit board assembly, and the electric shock sheets are connected to an output end of the ignition coil; when the electric shock/lighting change-over switch is in an electric shock gear, the pusher is pushed to result in relative displacement between the plastic main body part and the base plate under the action of the guide block, and when the guide block comes into contact with the electric shock switch, the electric shock head is powered on and the two electric shock sheets generate an electric shock; when the electric shock/lighting change-over switch is in a lighting gear, the pusher is pressed down to turn on the lighting switch so that the LED lamp is powered on to operate.

A push-out type miniature electric shock flashlight capable of automatically resetting further includes a limiting structure; and a step is provided at a joint between the operating member and the power control member, and a rabbet is provided at one end of the flashlight body shell. As another embodiment, the length of the operating member is smaller than the length of an opening of the open slot.

Buckles are provided on two sides of the detachable cover plate, and bayonets are provided on the power control member at corresponding positions.

The base plate is clamped with the plastic main body part and is connected to the flashlight body shell by the rabbet structure.

The elastic element is a spring.

The electric shock sheets are in a dentate structure or an acicular structure.

Compared with the prior art, the present invention has the beneficial effects as follows.

According to the push-out type miniature electric shock flashlight capable of automatically resetting and having a USB interface of the present invention, the LED lamp can be controlled by the lighting switch, and the electric shock sheets can be controlled by the pusher and the electric shock switch to discharge. Hence, it is safe and reliable when in use for the purpose of self-defensing. Meanwhile, it is small in size, beautiful, easy to carry, practical and convenient.

BRIEF DESCRIPTION OF THE DRAWINGS

FIG. 5 is a structural scheme of a flashlight body shell of the present invention, in which:

Figure 1:
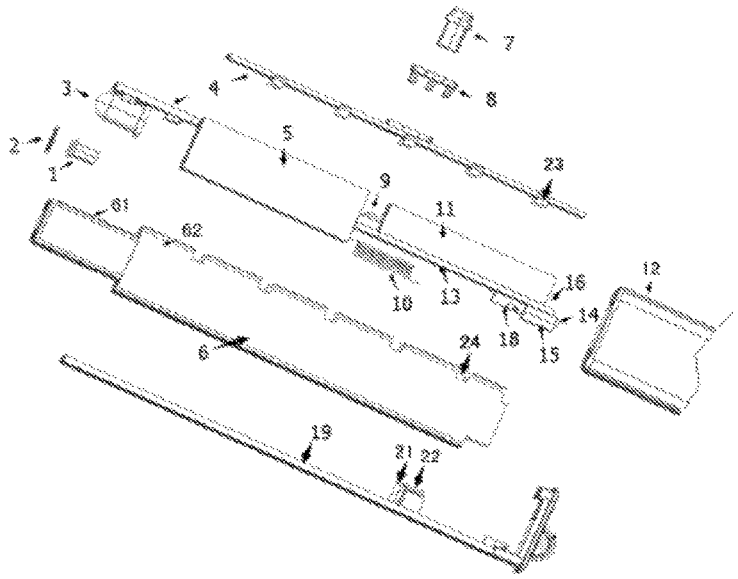
FIG. 1 is an exploded structure diagram of the present invention.
Figure 2:
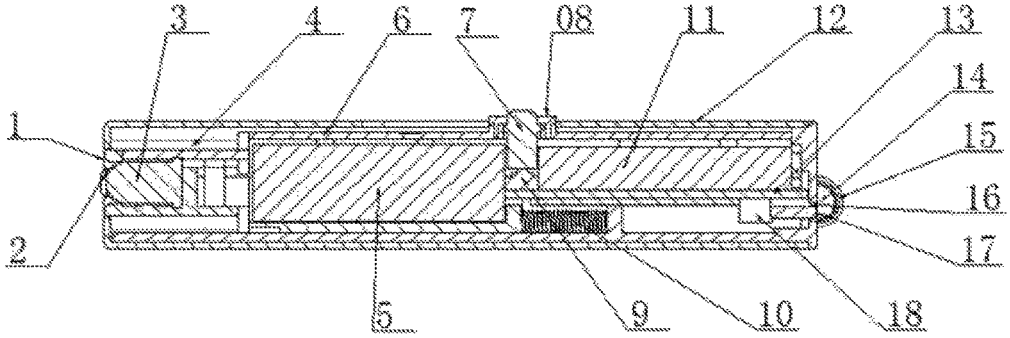
FIG. 2 is an assembly structure diagram of the present invention.
Figure 3:
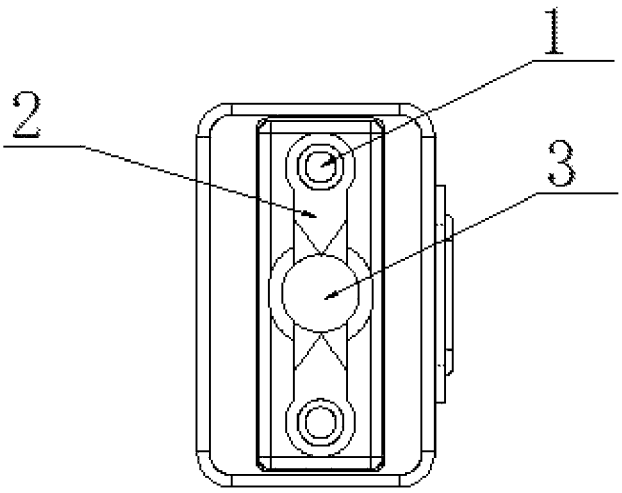
FIG. 3 is a left view of FIG. 2.
Figure 4:
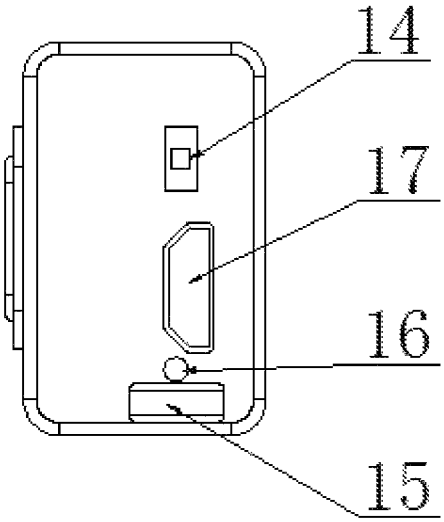
FIG. 4 is a right view of FIG. 2.
Figure 5:
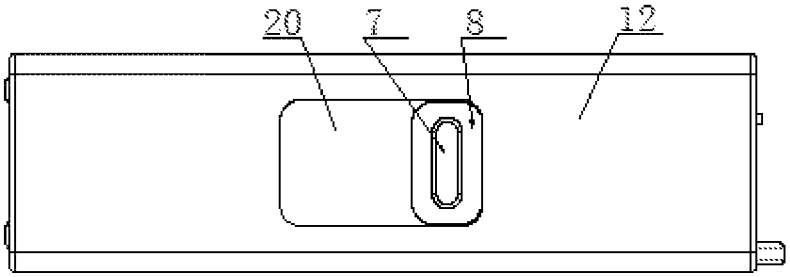

1: electric shock head
2: electric shock sheet
3: LED lamp
4: detachable cover plate
5: ignition coil
6: plastic main body part
61: operating member
62: power control member
7: pusher
8: decorative sheet
9: lighting switch
10: elastic element
11: polymer lithium battery
12: flashlight body shell
13: integrated circuit board assembly

14: electric shock/lighting change-over switch
15: strap hole
16: charging indicator
17: USB interface
18: electric shock switch
19: base plate
20: open slot
21: joint pin
22: guide block
23: buckle
24: bayonet

DETAILED DESCRIPTION OF THE INVENTION

A further description will be made to the present invention below with reference to the accompanying drawings, but not used as a limitation to the present invention.

A push-out type miniature electric shock flashlight capable of automatically resetting is provided, including a flashlight body shell 12, a plastic main body part 6, an integrated circuit board assembly 13 and a base plate 19, an open slot 20 being provided above the flashlight body shell 12.

The plastic main body part 6 is a cuboid structure having an opening on one face and comprises an operating member 61 and a power control member 62, an LED lamp 3, having an electric shock head 1 and symmetrically arranged electric shock sheets 2 provided on two sides thereof, is provided inside the operating member 61, and the electric shock sheets 2 are in a dentate structure or an acicular structure. An ignition coil 5 and a polymer lithium battery 11, which are connected and covered by a detachable cover plate 4, are provided inside the power control member 62, the cover plate 4 is connected and fixed to a pusher 7 by a decorative sheet 8, and a guide slot is also provided on a bottom surface of the power control member 62.

The circuit board assembly 13 is arranged between the polymer lithium battery 11 and the plastic main body part 6 and comprises a lighting switch 9, an electric shock/lighting change-over switch 14, a charging indicator 16, a USB interface 17 and an electric shock switch 18, and the lighting switch 9 is located in the same vertical direction as the pusher 7. A joint pin 21 and a guide block 22 which coordinates with the guide slot are provided on the base plate 19, and the joint pin 21 is coupled to the plastic main body part 6 by an elastic element 10. The elastic element 10 is a spring.

The flashlight further comprises a limiting structure; and a step is provided at a joint between the operating member 61 and the power control member 62, and a rabbet is provided at one end of the flashlight body shell 12. As another embodiment, the length of the operating member 61 is smaller than the length of an opening of the open slot 20.

Buckles 23 are provided on two sides of the detachable cover plate 4, and bayonets 24 are provided on the power control member 62 at a corresponding position.

The base plate 19 is clamped with the plastic main body part 6 and is connected to the flashlight body shell 12 by the rabbet structure.

A strap hole 15 is also provided at one end of the base plate 19.

An input end of the ignition coil 5 is connected to an output end of the polymer lithium battery 11 whose input end is connected to the USB interface 17 by the integrated circuit board assembly 13, and the electric shock sheets 2 are connected to an output end of the ignition coil 5.

When the electric shock/lighting change-over switch 14 is in an electric shock gear, the pusher 7 is pushed to drive result in relative displacement between the plastic main body part 6 and the base plate 19 under the action of the guide block 22, and when the guide block 22 is incomes into contact with the electric shock switch 18, the electric shock head 1 is powered on, the two electric shock sheets 2 generate an electric shock, and the plastic main body part 6 can be controlled by the spring to automatically reset.

When the electric shock/lighting change-over switch 14 is in a lighting gear, the pusher 7 is pressed down to turn on the lighting switch 9 so that the LED lamp is powered on to operate.

The push-out type miniature electric shock flashlight capable of automatically resetting has an external size of 88×25×15 mm.

The above embodiments of the present invention are merely used for clearly illustrating the examples given in the present invention, but not used for limiting the scope of the present invention. All equivalent technical solutions shall fall into the scope of the present invention, and the protection scope of the present invention shall be defined by the appended claims.

The invention claimed is:

1. A push-out type miniature electric shock flashlight capable of automatically resetting, comprising a flashlight body shell (12), a plastic main body part (6), an integrated circuit board assembly (13) and a base plate (19), an open slot (20) being provided above the flashlight body shell (12); the plastic main body part (6) is a cuboid structure having an opening on one face and comprises an operating member (61) and a power control member (62), and an LED lamp (3), having an electric shock head (1) and symmetrically arranged electric shock sheets (2) provided on two sides thereof, is provided inside the operating member (61); an ignition coil (5) and a polymer lithium battery (11), which are connected and covered by a detachable cover plate (4), are provided inside the power control member (62), the cover plate (4) is connected and fixed to a pusher (7) by a decorative sheet (8), and a guide slot is also provided on a bottom surface of the power control member (62); the circuit board assembly (13) is arranged between the polymer lithium battery (11) and the plastic main body part (6) and comprises a lighting switch (9), an electric shock/lighting change-over switch (14), a charging indicator (16), a USB interface (17) and an electric shock switch (18), and the lighting switch (9) is located in the same vertical direction as the pusher (7); a joint pin (21) and a guide block (22) which coordinates with the guide slot are provided on the base plate (19), and the joint pin (21) is coupled to the plastic main body part (6) by an elastic element (10).

2. The push-out type miniature electric shock flashlight capable of automatically resetting according to claim 1, characterized in that an input end of the ignition coil (5) is connected to an output end of the polymer lithium battery (11) whose input end is connected to the USB interface (17) by the integrated circuit board assembly (13), and the electric shock sheets (2) are connected to an output end of the ignition coil (5).

3. The push-out type miniature electric shock flashlight capable of automatically resetting according to claim 1, characterized in that, when the electric shock/lighting change-over switch (14) is in an electric shock gear, the pusher (7) is pushed to result in relative displacement between the plastic main body part (6) and the base plate (19) under the action of the guide block (22), and when the guide block (22) comes into contact with the electric shock switch (18), the electric shock head (1) is powered on and the two electric shock sheets (2) generate an electric shock.

4. The push-out type miniature electric shock flashlight capable of automatically resetting according to claim 1, characterized in that, when the electric shock/lighting change-over switch (14) is in a lighting gear, the pusher (7) is pressed down to turn on the lighting switch (9) so that the LED lamp (3) is powered on to operate.

5. The push-out type miniature electric shock flashlight capable of automatically resetting according to claim 1, further comprising a limiting structure; and a step is provided at a joint between the operating member (61) and the power control member (62), and a rabbet is provided at one end of the flashlight body shell (12).

6. The push-out type miniature electric shock flashlight capable of automatically resetting according to claim 1, further comprising a limiting structure; and the length of the operating member (61) is smaller than the length of an opening of the open slot (20).

7. The push-out type miniature electric shock flashlight capable of automatically resetting according to claim 1, characterized in that buckles (23) are provided on two sides of the detachable cover plate (4), and bayonets (24) are provided on the power control member (62) at corresponding positions.

8. The push-out type miniature electric shock flashlight capable of automatically resetting according to claim 1, wherein the base plate (19) is clamped with the plastic main body part (6) and is connected to the flashlight body shell (12) by the rabbet structure.

9. The push-out type miniature electric shock flashlight capable of automatically resetting according to claim 1, characterized in that the elastic element (10) is a spring.

10. The push-out type miniature electric shock flashlight capable of automatically resetting according to claim 1, characterized in that the electric shock sheets (2) are in a dentate structure or an acicular structure.

* * * * *